US007011137B2

(12) United States Patent
Itoh

(10) Patent No.: US 7,011,137 B2
(45) Date of Patent: Mar. 14, 2006

(54) MOLDING DEVICE

(75) Inventor: Akira Itoh, Inazawa (JP)

(73) Assignee: Toshihara Kanagata Kogyo Co., LTD, Aichi-Ken (JP)

( * ) Notice: Subject to any disclaimer, the term of this patent is extended or adjusted under 35 U.S.C. 154(b) by 122 days.

(21) Appl. No.: 10/413,932

(22) Filed: Apr. 14, 2003

(65) Prior Publication Data

US 2003/0228389 A1 Dec. 11, 2003

(30) Foreign Application Priority Data

Apr. 17, 2002 (JP) ..... 2002-114284
Dec. 6, 2002 (JP) ..... 2002-355594
Jan. 8, 2003 (JP) ..... 2003-002462

(51) Int. Cl.
*B22D 17/12* (2006.01)
*B22D 17/14* (2006.01)
*B22D 17/32* (2006.01)

(52) U.S. Cl. ..... 164/312; 164/319; 164/306; 164/254; 164/155.2

(58) Field of Classification Search ..... 164/61, 164/254, 133, 136, 312, 306, 113, 120, 319, 164/457, 155.2, 155.4, 154.2
See application file for complete search history.

(56) References Cited

U.S. PATENT DOCUMENTS 4,347,889 A * 9/1982 Komatsu et al. ..... 164/250.1
4,860,818 A * 8/1989 Dannoura ..... 164/314
5,076,344 A * 12/1991 Fields et al. ..... 164/457
5,127,467 A * 7/1992 Ueno ..... 164/457
5,343,927 A * 9/1994 Ivansson ..... 164/120
5,839,497 A * 11/1998 Fujino et al. ..... 164/113

FOREIGN PATENT DOCUMENTS

| | | |
|---|---|---|
| DE | 199 21 496 A1 | 11/2000 |
| EP | 0 790 090 A2 | 8/1997 |
| EP | 0 813 922 A1 | 12/1997 |
| JP | 16-7325 | of 0000 |
| JP | 51-085018 | 12/1949 |
| JP | 44-012122 | 6/1969 |

(Continued)

*Primary Examiner*—Kiley S. Stoner
*Assistant Examiner*—Kevin McHenry
(74) *Attorney, Agent, or Firm*—Vidas, Arrett & Steinkraus PA

(57) ABSTRACT

The molding device comprises a lower mold unit and an upper mold unit. When the upper mold unit approaches the lower mold unit, a molding cavity is defined between the lower and upper mold units. The lower mold unit has a storing chamber that is communicated with the molding cavity. The lower mold unit comprises a pressure-decreasing mechanism and a pushing mechanism. A molten material is stored in the storing chamber. When the molding cavity is formed between the lower mold unit and the upper mold unit, the pressure-decreasing mechanism decreases pressure in the molding cavity. Afterwards, in sync with the operation that the upper mold unit pushing down a lower mold-holding member of the lower mold unit, an injection rod of the pushing mechanism pushes out the molten material in the storing chamber to the molding cavity. As a result, the efficiency of the molding operation is improved.

14 Claims, 11 Drawing Sheets

FOREIGN PATENT DOCUMENTS

| | | | | |
|---|---|---|---|---|
| JP | 54-133427 | | | 10/1979 |
| JP | 55008382 | A | * | 1/1980 |
| JP | 55008382 | | | 1/1980 |
| JP | 57-195575 | | | 12/1982 |
| JP | 59215259 | A | * | 12/1984 |
| JP | 61049764 | A | * | 3/1986 |
| JP | 5-63264 | B2 | | 8/1986 |
| JP | 61-180659 | A | | 8/1986 |
| JP | 61182868 | A | * | 8/1986 |
| JP | 2519416 | B2 | | 9/1987 |
| JP | 62-278012 | | | 12/1987 |
| JP | 01-313171 | | | 12/1989 |
| JP | 7-22815 | B2 | | 10/1990 |
| JP | 02247062 | A | * | 10/1990 |
| JP | 3285749 | | | 12/1991 |
| JP | 05285628 | A | * | 11/1993 |
| JP | 06-210426 | | | 8/1994 |
| JP | 2002-114284 | A | | 4/2002 |
| JP | 2002-355594 | A | | 12/2002 |
| JP | 2003-2462 | A | | 1/2003 |
| WO | 01/05537 | A1 | | 1/2001 |

* cited by examiner

MOLDING DEVICE

BACKGROUND OF THE INVENTION

The present invention is related to a molding device for molding various products in a cavity.

A conventional molding device as shown in FIG. 17 has been proposed. The molding device comprises a fixed mold 113 and a mold-holding member 115. The fixed mold 113 is detachably mounted to a mold-holding member 112 that is fixed to a bed 111. The mold-holding member 115 is mounted so as to reciprocate along guide rails 114 in the front and rear direction (left and right direction as viewed in FIG. 17) with respect to the mold-holding member 112. A movable mold 116 is detachably mounted to the mold-holding member 115. An injection mechanism 117 is arranged at the right side of the bed 111. Liquid metal such as aluminum is fed via the injection mechanism 117 into a cavity that is formed by the fixed mold 113 and the movable mold 116 that are closed to mold a product. The injection mechanism 117 comprises a sleeve 118. The sleeve 118 includes a storing chamber 119 for the molten metal that penetrates through the mold-holding member 112 to be communicated to the fixed mold 113. An injection opening 120 for the molten metal is formed at an outer edge of the sleeve 118. An injection rod 121 is inserted in the storing chamber 119 and is reciprocated by a cylinder 122.

In the above molding device, the molten metal is injected into the storing chamber 119 from the injection opening 120 while the movable mold 116 is in a closed state with respect to the fixed mold 113. Then, the injection rod 121 is moved forward by the cylinder 122 so that the molten metal in the storing chamber 119 is pressed into the cavity. Therefore, the number of process steps of the molding operation is three, including the mold closing, the injection of the molten metal, and the pressing of the molten metal. The efficiency of the molding operation is decreased and manufacturing cost is increased because of the number of process steps.

In the above molding device, the pressure in the cavity is decreased after closing the molds so that the air in the cavity is not mixed with the molten metal during the injection molding. However, if the pressure is decreased to a high negative pressure, outer air penetrates into the storing chamber 119 through a small opening between an outer circumferential surface and an inner circumferential surface of the sleeve 118. The outer air is led into the cavity and fine bubbles are mixed with the molten metal, and the quality of the molding is decreased. Therefore, it is difficult to increase the negative pressure and improve the quality of the molding.

SUMMARY OF THE INVENTION

An object of the present invention is to provide a molding device that improves the efficiency of a molding operation and the quality of molding.

To achieve the foregoing and other objectives and in accordance with the purpose of the present invention, a molding device including a first mold unit, a second mold unit, a storing chamber, and a pushing mechanism is provided. The second mold unit is arranged to face the first mold unit. The first mold unit and the second mold unit relatively approach and are separated from each other. When the first mold unit and the second mold unit approach each other to be closed, a molding cavity is defined between the first mold unit and the second mold unit. The storing chamber is arranged in at least one of the first mold unit and the second mold unit. The storing chamber is communicated with the molding cavity and stores molten material. The pushing mechanism pushes out the molten material in the storing chamber to the molding cavity when the molding cavity is defined between the first mold unit and the second mold unit.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
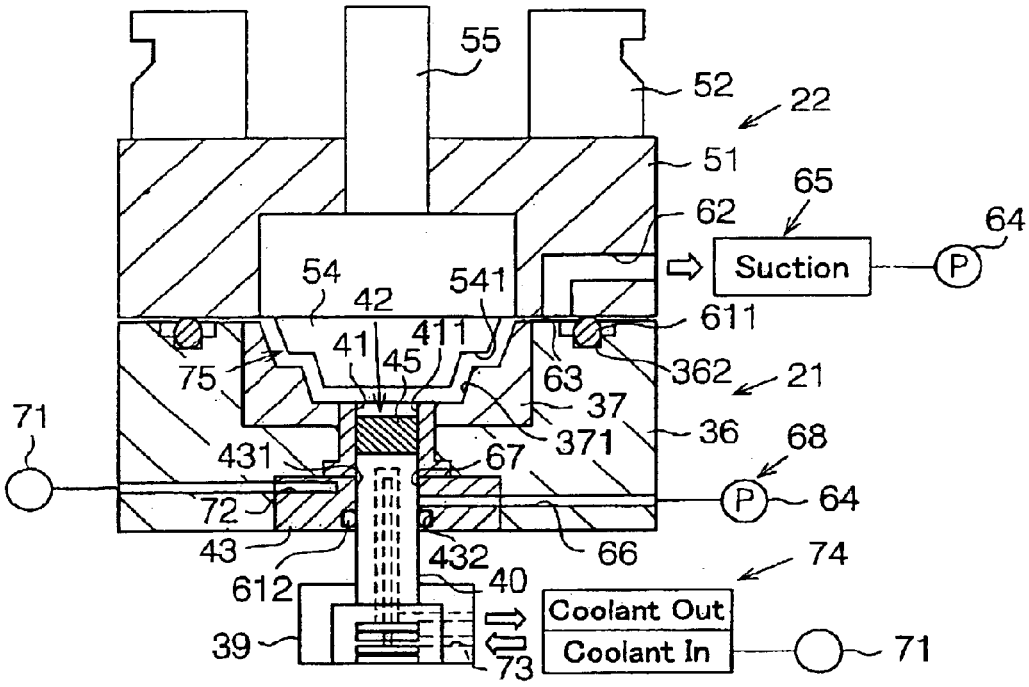
FIG. 1 is a cross sectional view of a main portion of a molding device according to a first embodiment of the present invention.

Hereinafter, a molding device according to one embodiment of the present invention will be explained with reference to FIGS. 1–7.

A structure of a whole molding device will be explained with reference to FIG. 7.

Legs 12 are arranged on a lower surface of a lower support stand 11 and guide supports 13 are arranged at a plurality of positions (four in this embodiment) on an upper surface of the lower support stand 11 so as to extend upward parallel to each other. An upper support stand 14 is arranged horizontally between the upper end portions of the guide supports 13. A lift plate 15 is arranged at an upper portion of each guide support 13 so as to reciprocate up and down. The lift plate 15 is lifted or lowered by piston rods 17 of a plurality of cylinders 16 (only one is shown) that are fixed downwardly to the upper support stand 14.

A lower mold unit 21 that serves as a first mold unit is arranged on an upper surface of the lower support stand 11 so as to be positioned between the guide supports 13. An upper mold unit 22 that serves as a second mold unit is arranged on a lower surface of the lift plate 15. A mold unit 23 comprises the lower mold unit 21 and the upper mold unit 22.

A structure of the lower mold unit 21 and the upper mold unit 22 of the mold unit 23 will be explained with reference to FIGS. 1 and 2.

Figure 2:
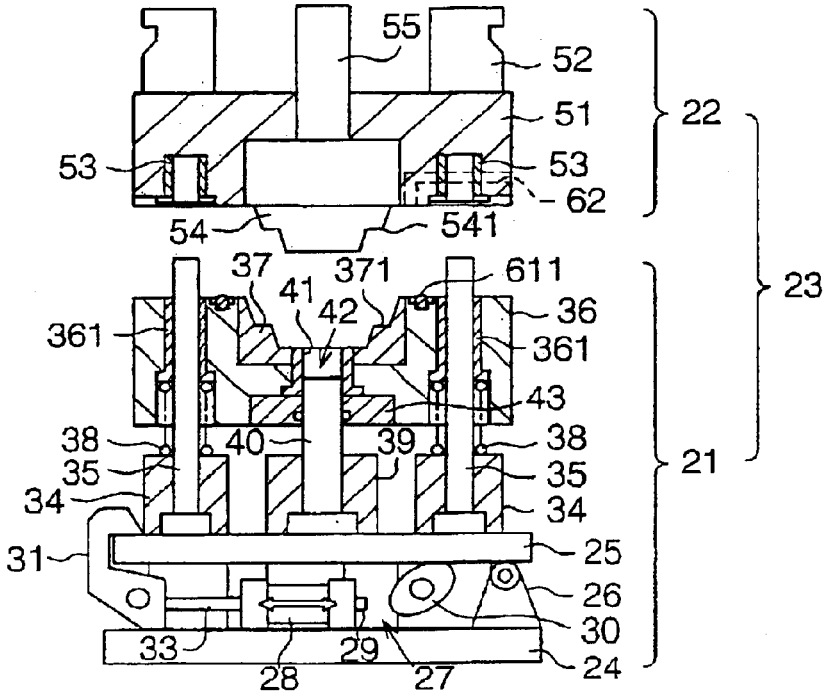
FIG. 2 is a cross sectional view showing an open state of a mold unit that is arranged in the molding device of FIG. 1.
Figure 7:
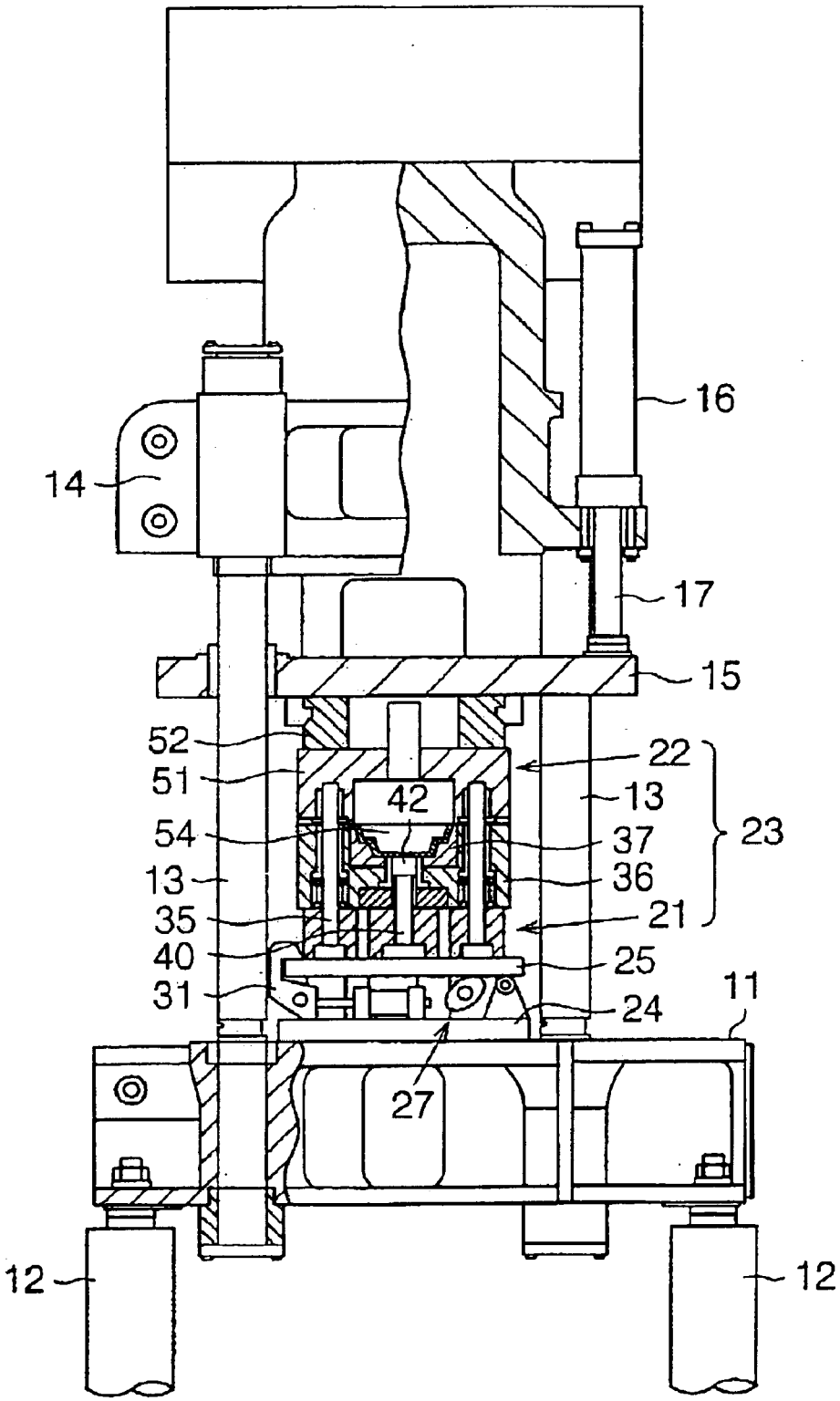
FIG. 7 is a cross sectional view of the whole molding device of the first embodiment.

A base plate 24 of the lower mold unit 21 shown in FIG. 2 is mounted on an upper surface of the lower support stand 11 shown in FIG. 7 by a clamp mechanism (not shown). A horizontal support plate 25 is arranged on an upper surface of the base plate 24 via a hinge mechanism 26 so as to be tilted up and down. A tilt mechanism 27 is arranged between the base plate 24 and the horizontal support plate 25 so as to tilt the horizontal support plate 25. The tilt mechanism 27 comprises a tilt cylinder 28 and a cam 30. The tilt cylinder 28 is supported horizontally on the upper surface of the base plate 24. The cam 30 is operated by a piston rod 29 of the tilt cylinder 28. A lock lever 31 is supported at the left end of the base plate 24 so as to be tilted left and right direction. The lock lever 31 is maintained at a locked position by a piston rod 33 that is extended to the left end of the tilt cylinder 28.

A pair of seats 34 is fixed to the left and right sides of the upper surface of the horizontal support plate 25. Cylindrical guide rods 35 that serve as a guide mechanism are arranged in the seats 34 so as to extend upwardly and parallel to each other. A lower mold-holding member 36 of a metal material, such as iron, is fitted to the guide rod 35 via a cylindrical sleeve 361 so as to reciprocate up and down. A lower mold 37 is accommodated detachably in a center position of the upper surface of the lower mold-holding member 36. A coil spring 38 that serves as a lift maintaining mechanism is arranged between the upper surface of each seat 34 and the lower surface of the sleeve 361 in the lower mold-holding member 36 and always maintains the lower mold-holding member 36 elastically at a predetermined height. The lower mold-holding member 36 and the lower mold 37 form a movable member.

A seat 39 is fixed at a center of the upper surface of the horizontal support plate 25. An injection rod 40 that serves as a pushing rod, or a pushing mechanism, is extended from the seat 39 upwardly. A cylindrical member 41 is fitted and fixed in the center of the lower mold-holding member 36 and the lower mold 37. A guide member 43 is fitted in the center of the lower surface of the lower mold-holding member 36 and fixed to the lower mold-holding member 36 by a bolt (not shown). The upper end of the injection rod 40 is inserted to a penetration hole 431 that is formed in the guide member 43 and an inner circumferential surface 411 of the cylindrical member 41. A space of a cylindrical shape with a bottom that is formed by the inner circumferential surface 411 of the cylindrical member 41 and the upper end surface of the injection rod 40 is a storing chamber 42 for storing a material to be molded such as metal. The molten metal 45 is injected from the upper direction into the storing chamber 42.

An upper mold unit 22 that is mounted on the lift plate 15 will be explained. Connection members 52 are connected to a plurality of positions of the upper surface of an upper mold-holding member 51 of a metal material. The connection members 52 are fixed to the lower surface of the lift plate 15 shown in FIG. 7 via a clamp mechanism (not shown). A pair of cylindrical guide members 53 is arranged on two ends of the lower surface of the upper mold-holding member 51 corresponding to the guide rods 35 of the lower mold unit 21. When the upper mold unit 22 is lowered, the guide rods 35 are inserted to the corresponding cylindrical guide members 53 and the upper mold-holding member 51 is guided along the guide rods 35. An upper mold 54 is detachably arranged in the center of the lower surface of the upper mold-holding member 51. A support rod 55 is arranged in the upper mold-holding member 51 for maintaining the upper mold 54. A cavity 75 is formed by a second molding surface 541 that is formed in the upper mold 54 and a first molding surface 371 that is formed in the lower mold 37. A product of a predetermined shape is molded in the cavity 75.

A first pressure-decreasing mechanism 65 and a second pressure-decreasing mechanism 68 will be explained. The first pressure-decreasing mechanism is arranged in the upper mold unit 22 and the second pressure-decreasing mechanism 68 is arranged in the lower mold unit 21.

A circular groove 362 is formed in the upper surface of the lower mold-holding member 36 so as to surround the lower mold 37. A first seal ring 611 that serves as a first seal member is accommodated in the circular groove 362 so as to be extended upwardly from the upper surface of the lower mold-holding member 36.

A first pressure-decreasing passage 62 is formed in a predetermined position of the upper mold-holding member 51. The first pressure-decreasing passage 62 is open at the lower surface of the upper mold-holding member 51. A start end of the opening of the first pressure-decreasing passage 62 is communicated to a first space 63 that is formed between the holding members 36 and 51 when the lower mold-holding member 36 and the upper mold-holding member 51 are close to each other as shown in FIG. 1 and the first seal ring 611 functions as a seal member. The basal end of the first pressure-decreasing passage 62 is connected to a pressure-decreasing pump 64. In this embodiment, the first pressure-decreasing mechanism 65 comprises the first seal ring 611, the first pressure-decreasing passage 62, the first space 63, the pressure-decreasing pump 64, and other components.

A circular groove 432 is formed in a penetration hole 431 of the guide member 43 and a second seal ring 612 of rubber that serves as a second seal member is accommodated in the circular groove 432. A second pressure-decreasing passage 66 is formed in the lower mold-holding member 36 and the guide member 43. A start end of the opening of the second pressure-decreasing passage 66 is open to a second space 67 that is formed between the outer circumferential surface of the injection rod 40 and the penetration hole 431 of the guide member 43. The position of the opening is set between the second seal ring 612 and the storing chamber 42. The second pressure-decreasing passage 66 is connected to the pressure-decreasing pump 64. In this embodiment, the second pressure-decreasing mechanism 68 comprises the second seal ring 612, the second pressure-decreasing passage 66, the second space 67, the pressure-decreasing pump 64, and other components.

A cooling mechanism 74 of the second seal ring 612 that is arranged in the guide member 43 will be explained.

Coolant that is supplied from a water source 71 such as tap water as shown in FIG. 1 is supplied to a first cooling passage 72 that is arranged in the lower mold-holding member 36 and the guide member 43. The first cooling passage 72 is arranged so as to surround the penetration hole 431 of the guide member 43 at a predetermined distance and indirectly cool down the second space 67. The water after cooling down is discharged outside via a discharge passage and a discharge pipe (not shown). A second cooling passage 73 is formed in the seat 39 and the injection rod 40. The inner portion of the injection rod 40 is cooled down by the coolant that is supplied from the water source 71 and this indirectly cools down the second seal ring 612. In this embodiment, the cooling mechanism 74 comprises the water source 71, the first cooling passage 72, the second cooling passage 73, and other components.

An operation of the above structured molding device will be explained. In FIGS. 2–6, the structure of the first pressure-decreasing mechanism 65 and the second pressure-decreasing mechanism 68 other than the first pressure-decreasing passage 62 is omitted.

Figure 3:
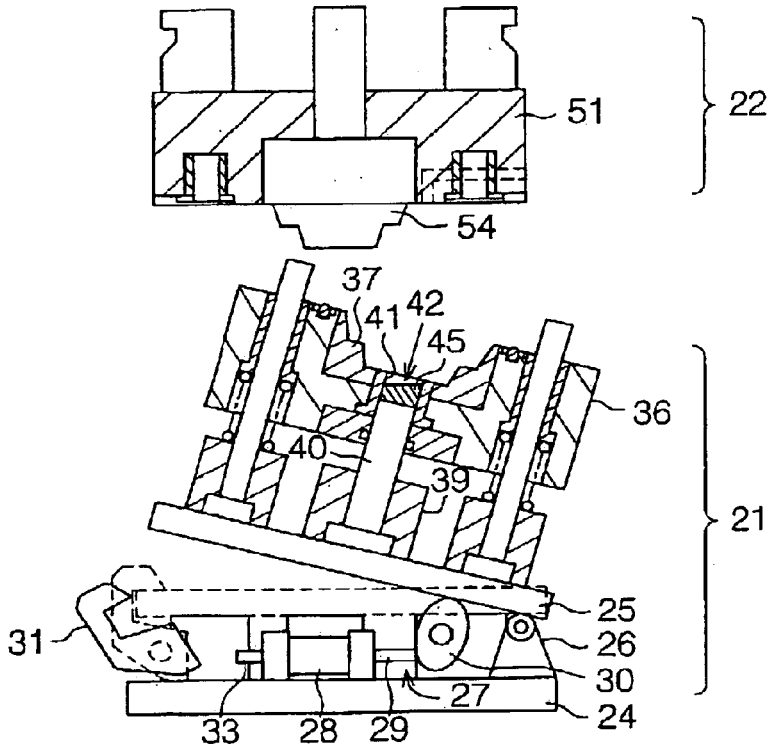
FIG. 3 is a cross sectional view of the first embodiment showing a lower mold-holding member of a lower mold unit when the lower mold-holding member is tilted.

FIG. 2 shows an open state in which the upper mold unit 22 is separated upwardly from the lower mold unit 21. In this state, the piston rod 33 of the tilt cylinder 28 is moved rearward (in the right direction in FIG. 2) and the locked condition of the lock lever 31 is released manually. The piston rod 29 of the tilt cylinder 28 of the tilt mechanism 27 is move forward (in the right direction in FIG. 2) to rotate the cam 30. Then, the horizontal support plate 25 and the lower mold-holding member 36 are rotated in the clockwise direction around the hinge mechanism 26 as shown in FIG. 3. In this state, the molten metal 45 is supplied to the storing chamber 42.

Figure 4:
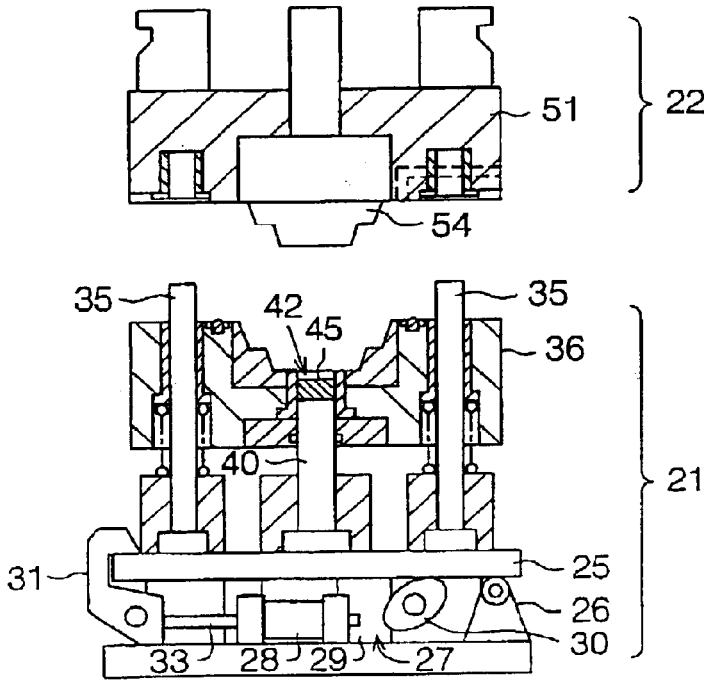
FIG. 4 is a cross sectional view of the first embodiment showing a storing chamber when molten metal is stored in the storing chamber.

Next, the piston rod 29 of the tilt mechanism 27 is moved rearward in FIG. 3, and the horizontal support plate 25 and the lower mold-holding member 36 return to the horizontal original position as shown in FIG. 4. Afterwards, the lock lever 31 is rotated by moving the piston rod 33 to the left so that the left end of the horizontal support plate is locked by the lock lever 31.

Figure 5:
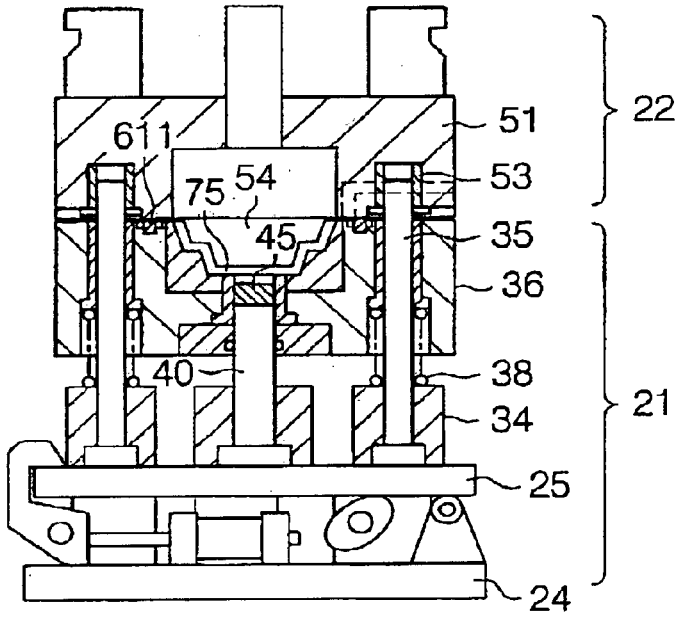
FIG. 5 is a cross sectional view of the first embodiment showing an upper mold-holding member of an upper mold unit arranged at an intermediate height position.

Next, the upper mold unit 22 is moved downwardly as shown in FIG. 5, and the upper mold-holding member 51 is stopped and maintained at the intermediate height position where the lower surface of the upper mold-holding member 51 approaches the upper surface of the lower mold-holding member 36. In this state, the first space 63 (refer to FIG. 1) is formed between the lower mold-holding member 36 and the upper mold-holding member 51 and the upper surface of the first seal ring 611 is pressed toward the lower surface of the upper mold-holding member 51 with an appropriate pressure. In the state shown in FIG. 1, the pressure-decreasing pump 64 is operated so that the air in the cavity 75 is discharged outside via the first pressure-decreasing passage 62 and the air in the second space 67 that is formed between the injection rod 40 and the guide member 43 is discharged outside via the second pressure-decreasing passage 66. The pressure in the second space 67 is maintained the same as that in the cavity 75.

The second space 67 is shut out from the cavity 75 by the molten metal 45 in the storing chamber 42. The pressure in the second space 67 acts on the lower surface of the molten metal 45, which is positioned on the opposite side of the cavity 75, while the pressure in the cavity 75 acts on the upper surface of the molten metal 45 in the storing chamber 42. Therefore, if the pressure in the second space 67 is higher than the pressure in the cavity 75, the molten metal 45 in the storing chamber 42 is lifted up toward the cavity 75 by the pressure in the second space 67. In other cases, the air in the second space 67 is mixed with the molten metal 45 in the storing chamber 42 as fine air bubbles. However, in this embodiment, since the pressure in the second space 67 is decreased to the same level as the pressure in the cavity 75, the molten metal 45 is prevented from moving in the storing chamber 42, and the air bubbles are prevented from being mixed with the molten metal 45.

Figure 6:
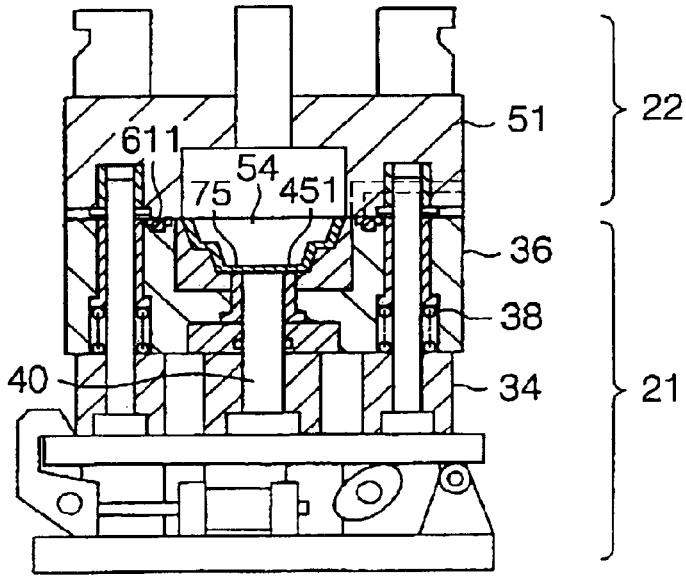
FIG. 6 is a cross sectional view of the first embodiment showing the lower mold unit and the upper mold unit when they are closed.

As shown in FIG. 6, the upper mold unit 22 is moved downwardly and the lower mold-holding member 36 is moved downwardly by the upper mold-holding member 51. At this time, because the first seal ring 611 is pressed by the lower surface of the upper mold-holding member 51, the first seal ring 611 is compressed in the circular groove 362 (refer to FIG. 1), the upper surface of the lower mold-holding member 36 and the lower surface of the upper mold-holding member 51 are in close contact with each other, and the molding device is in a closed state. The lower mold-holding member 36 is pressed upwardly by the upper mold-holding member 51 against the upward urging force of the coil spring 38 and the lower end surface of the lower mold-holding member 36 is in contact with the upper end surface of the seat 34. In the lowering process of the lower mold-holding member 36, the injection rod 40 is relatively moved upwardly in the cylindrical member 41 and the molten metal 45 stored in the storing chamber 42 is pressed into the cavity 75. Accordingly, a product 451 of a shape of the cavity 75 is molded.

After the product 451 is manufactured, the upper mold unit 22 is moved upwardly. Therefore, the upper mold-holding member 51 and the upper mold 54 are separated from the product 451 and the molding device is maintained in the open state, as shown in FIG. 2. As is not shown, the product 451 is pressed upwardly from the first molding surface 371 by a product pushing out pin that is arranged in the lower mold-holding member 36.

According to the molding device of the above embodiment, following advantages are obtained.

(1) In the above embodiment, the storing chamber 42 of the molten metal 45 is formed in the lower mold-holding member 36 and the lower mold 37 of the lower mold unit 21. The molten metal 45 in the storing chamber 42 is pressed into the cavity 75 by the injection rod 40 in connection with the mold closing operation of the lower mold unit 21 and the upper mold unit 22. Therefore, the conventional injection mechanism that is mounted outside is not necessary, the structure is simplified, and the molding device is small in size. Also, the devices are manufactured easily and the cost is decreased. The molten metal 45 in the storing chamber 42 is pressed into the cavity 75 corresponding to the mold closing operation of the lower mold unit 21 and the upper mold unit 22. Therefore, the number of steps of the molding operation is decreased by one step and operation efficiency is improved.

(2) In the above embodiment, the cavity 75 is maintained in a sealed state by the first seal ring 611 in a state that the upper mold-holding member 51 of the upper mold unit 22 is moved and stopped in adjacent to the upper surface of the lower mold-holding member 36. The second seal ring 612 is arranged between the sliding surfaces of the injection rod 40 and the guide member 43 and the molten metal 45 in the bottom of the storing chamber 42 and the corresponding second space 67 are maintained in a sealed state by the second seal ring 612. In this state, the pressure in the first space 63 and the second space 67 is decreased by the pressure-decreasing pump 64 into almost a vacuum state that is not achieved by the die-cast of a prior art. Therefore, the pressure in the cavity 75 is negative and almost vacuum to remove the air in the cavity 75. Accordingly, air bubbles are not mixed with the molten metal 45, and fine mold cavities are not generated in the products by mixed air bubbles. The quality of the products is improved. The degree that the molten metal 45 is oxidized by oxygen that is included in the air is extremely small. Therefore, the outer appearance of the products is improved.

(3) In the above embodiment, the cooling mechanism 74 cools the second seal ring 612, which is part of the second pressure-decreasing mechanism 68. Therefore, the second seal ring 612 is prevented from being deteriorated by the molten metal of a high temperature, and the durability of the second seal ring 612 is improved.

(4) In the above embodiment, the lower mold-holding member 36 of the lower mold unit 21 is maintained in a tilted position by the tilt mechanism 27 when the molding device is in an open state as shown in FIG. 3. Therefore, the molten metal 45 is easily injected into the storing chamber 42, the bubbles are not generated in the molten metal 45, and air bubbles are prevented from being mixed with the molten metal.

Next, a second embodiment of the present invention will be explained with reference to FIG. 8. In the following embodiment, the same numerals are applied to the parts that have same functions as the above embodiment and the explanation thereof is omitted.

In this embodiment, the seats 34 in the above embodiment are integrally formed. A cylinder 76 is formed at the center of the seat 34 and the injection rod 40 is connected to a piston 77 of the cylinder 76. A large diameter portion 401 is arranged at the upper end of the injection rod 40. A plurality of spring accommodation chambers 341 is formed in the upper surface of the seat 34 and coned disc springs 78 are accommodated therein.

A cover 79 is connected on the upper surface of the upper mold-holding member 51 and fixed to the upper mold-holding member 51 by bolts (not shown). A support plate 48 is accommodated in the cover 79 and a product pushing out pin 49 is connected to the support plate 48. The product pushing out pin 49 penetrates through the upper mold-holding member 51 and the upper mold 54 to enter the cavity 75. A cylinder 46 is fixed on the upper surface of the lift plate 15 upwardly and a piston rod 47 is penetrated through the cover 79 and connected to the support plate 48.

A seal ring 50 is arranged between the connection surfaces of the upper mold-holding member 51 and the cover. 79. A seal ring 50 is arranged between the outer circumferential surface of the piston rod 47 and the cover 79. A first pressure-decreasing passage 62 that is arranged in the upper mold-holding member 51 is communicated with a chamber 79 that accommodates the support plate 48.

A passage 82 that is arranged in the seat 34 is communicated with a pressure chamber 81 that is formed at the lower side of the piston 77. A relief valve 83 is arranged in the passage 82. A fluid such as oil is supplied to the pressure chamber 81 from a fluid supply device (not shown) and the pressure in the pressure chamber 81 is maintained at a predetermined pressure. In this embodiment, a position adjustment mechanism comprises the cylinder 76, the passage 82, the relief valve 83, and other components. The position adjustment mechanism adjusts the height position of the injection rod 40 in accordance with the amount of the material to be molded in the storing chamber 42.

In this embodiment, the cylinder 76 and the relief valve 83 function to compensate for fluctuations in the stored amount of the molten metal 45 in the storing chamber 42. For example, if there is an excessive amount of the molten metal 45 in the storing chamber 42, the injection rod 40 is pressed downward by the molten metal 45 when the mold unit is closed as shown in FIG. 8. Accordingly, the piston 77 presses the fluid in the pressure chamber 81. Then, to maintain the pressure in the pressure chamber 81, the fluid in the pressure chamber 81 is conducted out through the relief valve 83. As a result, the injection rod 40 is permitted to move downward, and the excessive amount of molten metal, which cannot flow into the cavity 75, remains in the storing chamber 42.

The coned disc spring 78 prevents the connection surfaces of the lower mold-holding member 36 and the upper mold-holding member 51 from being open when the lower mold-holding member 36 and the upper mold-holding member 51 are closed. A cylinder may be used for the coned disc spring 78.

This embodiment may be modified as follows.

Figure 9:
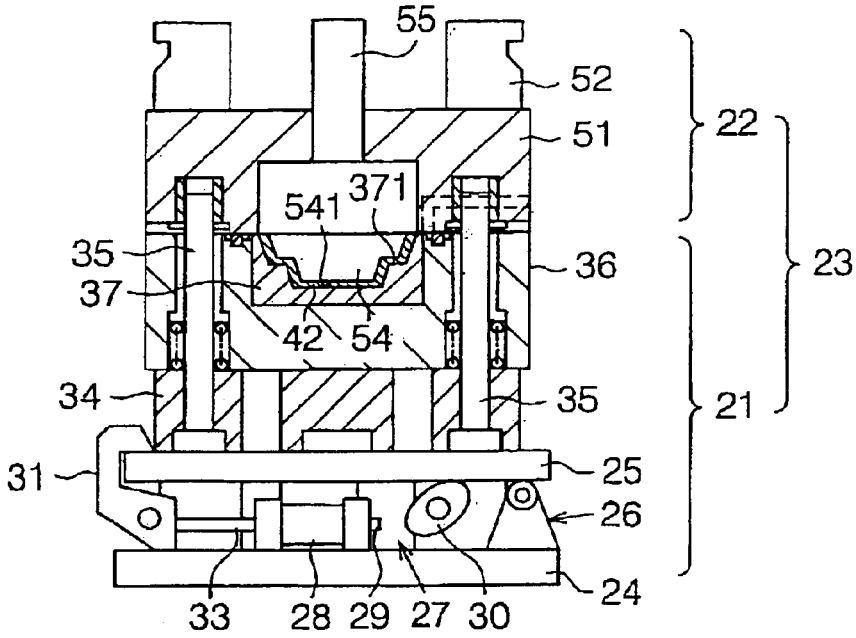
FIG. 9 is a cross sectional view of a molding device according to a modification of the second embodiment of the present invention.

As shown in FIG. 9, the storing chamber 42 may be arranged in the first molding surface 371 of the lower mold 37. The molten metal stored in the storing chamber 42 may be directly pressured by the second molding surface 541 of the upper mold 54 to mold a product. In this embodiment, a recess portion of the first molding surface 371 functions as the storing chamber 42 and the second molding surface 541 of the upper mold 54 functions as the injection rod 40.

Figure 10:
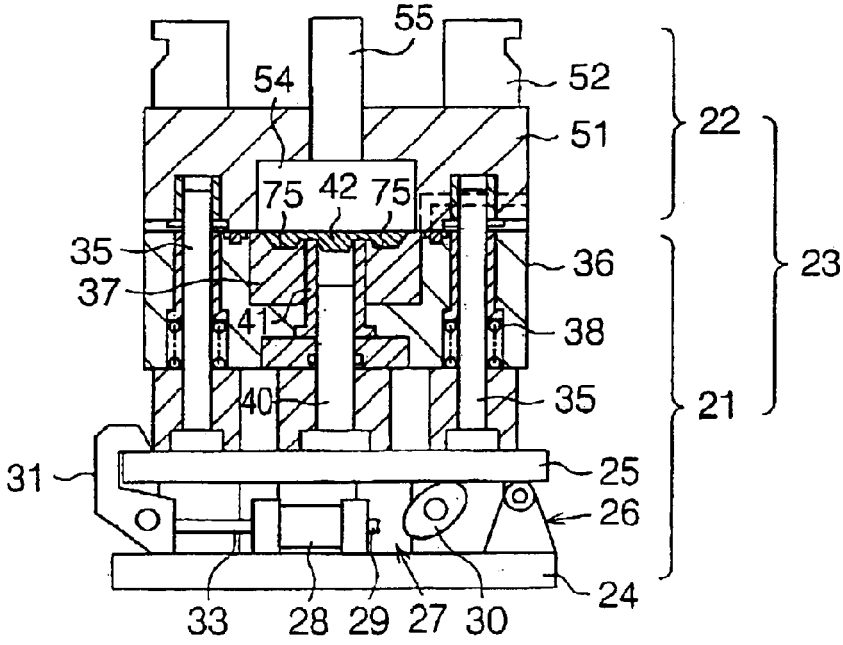
FIG. 10 is a cross sectional view of a molding device according to another modification of the second embodiment of the present invention.

As shown in FIG. 10, a plurality of cavities 75 may be arranged in the lower mold 37 to mold a plurality of products.

Figure 11:
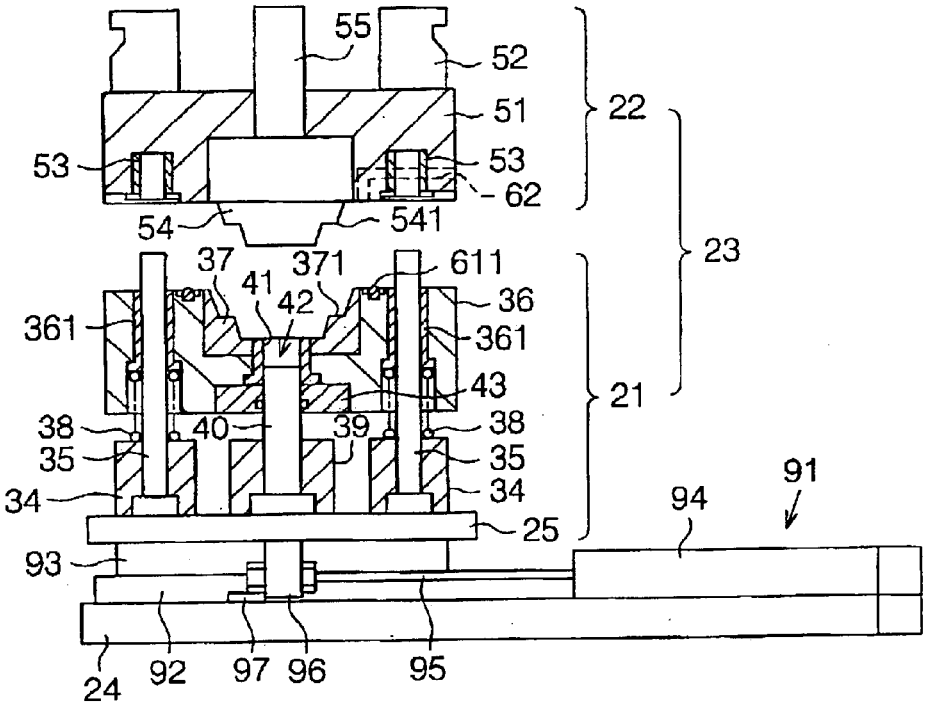
FIG. 11 is a cross sectional view of a molding device according to still another modification of the second embodiment of the present invention.
Figure 12:
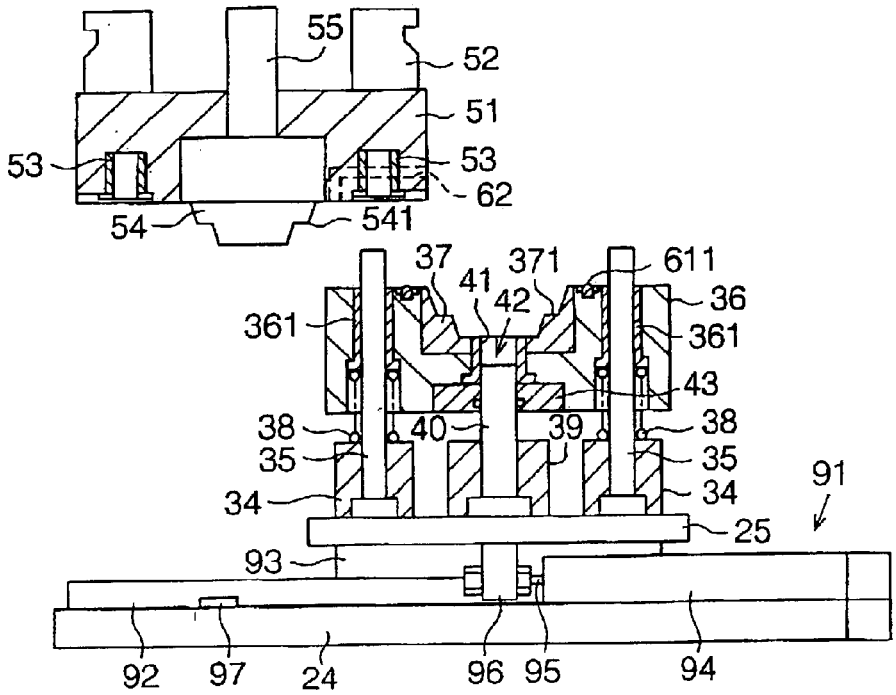
FIG. 12 is a cross sectional view showing a lower mold unit of the molding device of FIG. 11 that moves sideways.

As shown in FIGS. 11 and 12, a position switching mechanism 91 may be arranged for the tilt mechanism 27. The position switching mechanism 91 switches the position of the lower mold-holding member 36 by reciprocating the horizontal support plate 25 in a horizontal direction. A pair of guide rails 92 is arranged on the upper surface of the base plate 24 so as to be parallel to each other with a predetermined distance. A pair of guided members 93 that is fixed to the lower surface of the horizontal support plate 25 is supported above guide rails 92 so as to be reciprocated in the horizontal direction. A cylinder 94 is fixed horizontally on the upper surface of the base plate 24, and the distal end of a rod 95 of the cylinder 94 is connected to a bracket 96 that is arranged on the lower surface of the horizontal support plate 25. A position restriction member 97 is arranged on the upper surface of the base plate 24 corresponding to the bracket 96 so as to be adjusted horizontally by the position adjustment mechanism (not shown) The position of the bracket 96 is restricted by the position restriction member 97 and the lower holding member 36 is maintained at the position corresponding to the upper mold-holding member 51. As is not shown in FIGS. 11–16, the first pressure-decreasing mechanism 65, the second pressure decreasing mechanism 68, and the cooling mechanism 74 are provided in the modifications.

In this modification, the rod 95 of the cylinder 94 is moved rearward from the separated state, as shown in FIG.

11 and the lower mold-holding member 36 of the lower mold unit 21 is moved to the right side stand-by position as shown in FIG. 12. In this state, the molten metal is supplied into the storing chamber 42 from a supply device (not shown). When the supply of the molten metal is completed, the rod 95 of the cylinder 94 is moved forward so as to move the horizontal support plate 25 forward to the mold matching position, as shown in FIG. 11, and the upper mold unit 22 is lowered to the lower mold unit 21. The subsequent molding operation is same as that of the embodiment shown in FIG. 1.

Figure 13:
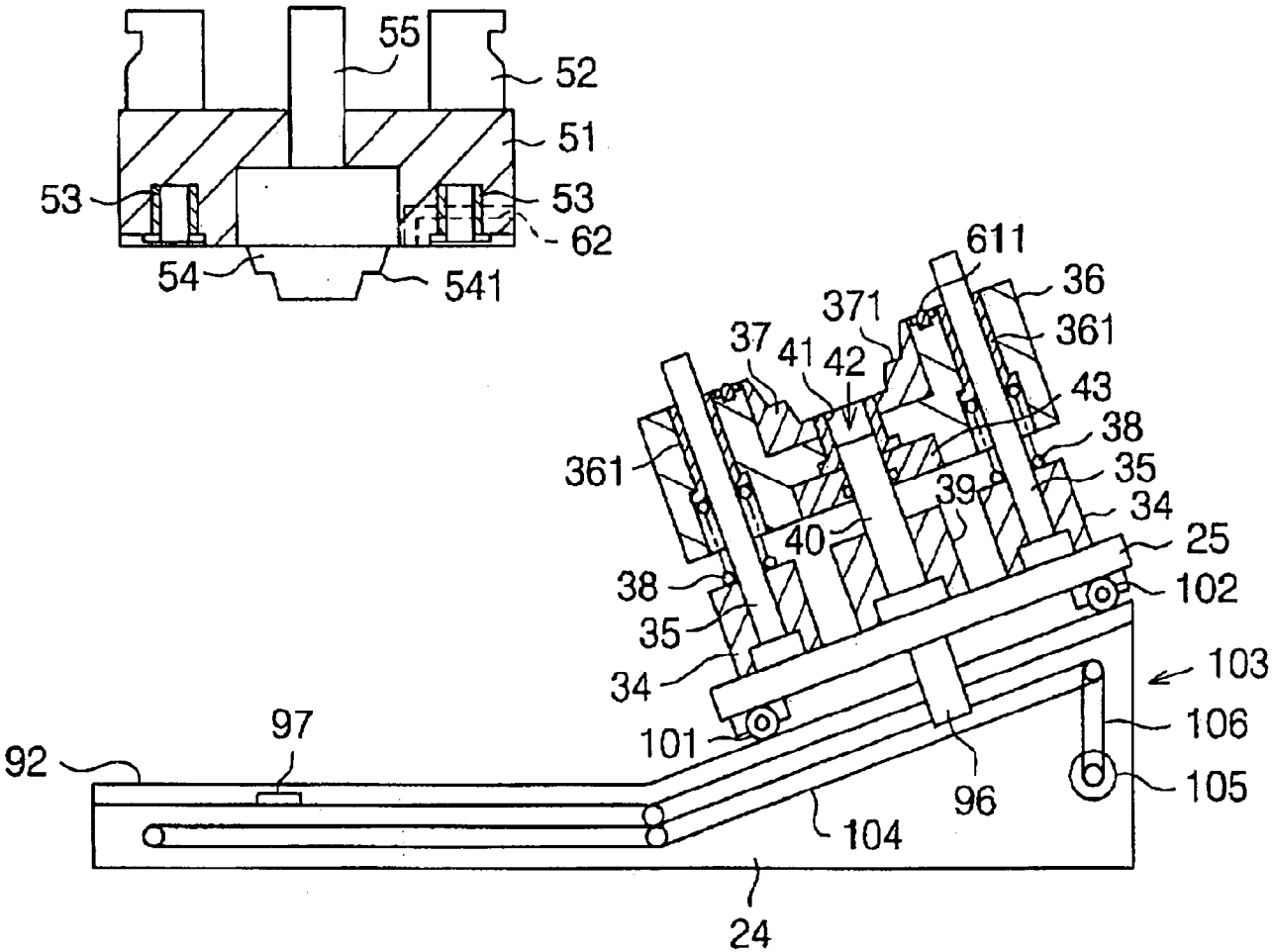
FIG. 13 is a cross sectional view of a molding device according to a modification of the modified second embodiment of the present invention shown in FIGS. 11 and 12.

As shown in FIG. 13, a pair of bent guide rails 92 may be arranged on the base plate 24 and rollers 101, 102 that are guided by the guide rails 92 may be arranged on the lower surface of the horizontal support plate 25. A chain 104 of a chain drive mechanism 103 may be engaged to the bracket 96 and the chain 104 may be rotated by a motor 105 and a chain 106 to switch the position of the horizontal support plate 25.

In this modification, the lower mold-holding member 36 and the storing chamber 42 are maintained in the stand-by position in a state that they are tilted. Therefore, the molten metal is injected into the storing chamber 42 in a state that the storing chamber 42 is tilted, the mixture of the air bubbles into the molten metal is decreased, and the molten metal is injected properly.

In this modification, when the molten metal is injected into the storing chamber 42 with moving the lower mold-holding member 36 into a slanted lower direction, the injection operation is carried out while the tilted angle of the storing chamber 42 is decreasing. Therefore, the molten metal is injected more properly and efficiently, with the air bubbles being prevented from mixing with the molten metal.

Figure 14:
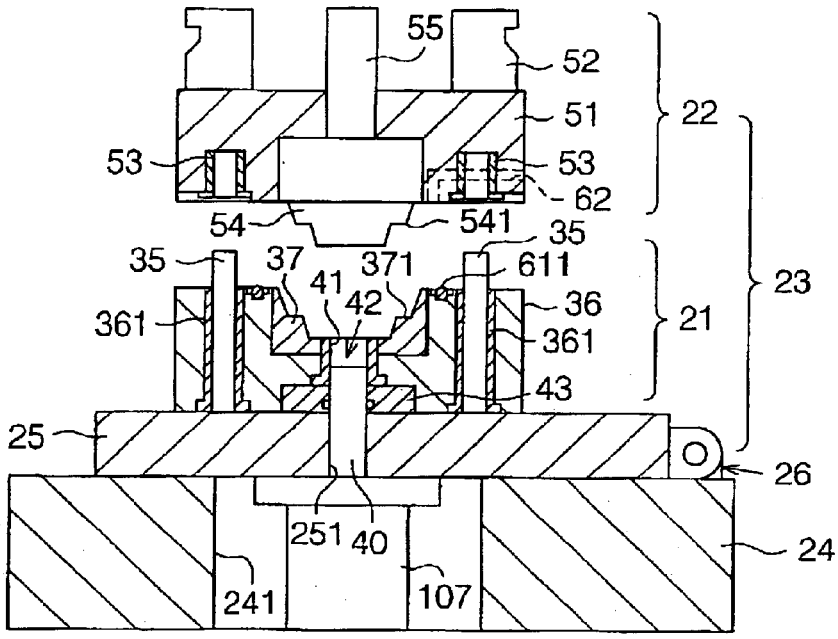
FIG. 14 is a cross sectional view of a molding device according to a modification of the first embodiment of the present invention.

In a modification shown in FIG. 14, the horizontal support plate 25 is arranged on the right end of the upper surface of the base plate 24 via a hinge mechanism 26 so as to be tilted An accommodation hole 241 of a large diameter is formed at the center of the base plate 24. A fluid pressure cylinder 107 is arranged upwardly on the lower surface of the horizontal support plate 25. A piston rod of the fluid pressure cylinder 107 is integrally formed with the injection rod 40 and is inserted loosely in a penetration aperture 251 that is formed in the horizontal support plate 25.

Figure 15:
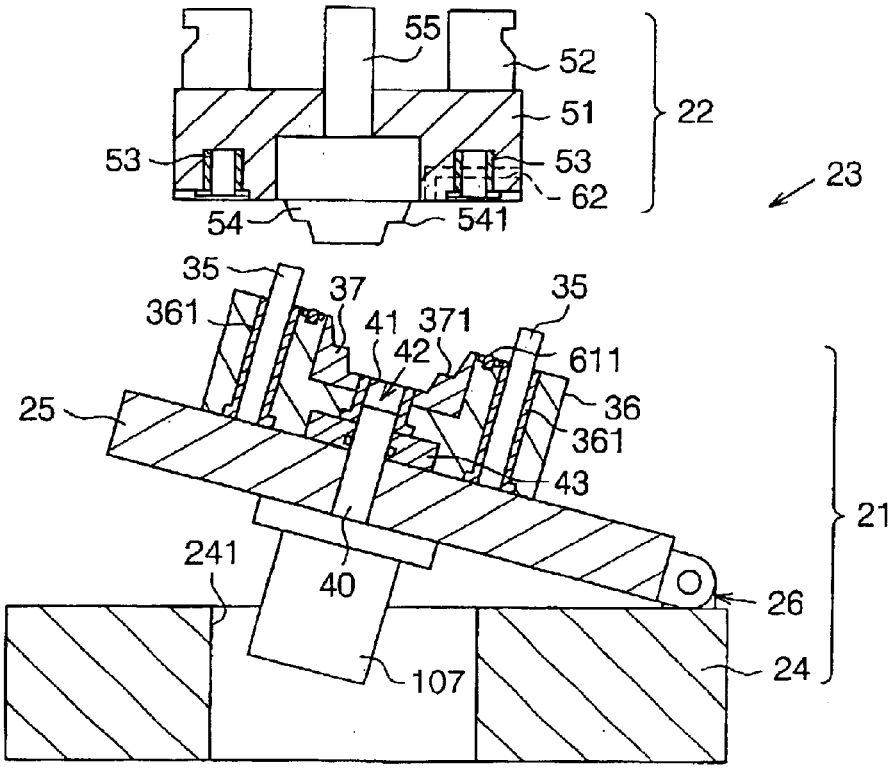
FIG. 15 is a cross sectional view showing that a condition of a mold unit of FIG. 14 is changed.

In this modification, when a tilt cylinder (not shown) that is arranged between the base plate 24 and the horizontal support plate 25 is operated in a state that the upper mold unit 22 is moved upwardly as shown in FIG. 15, the horizontal support plate 25 is tilted around the hinge mechanism 26 in the clockwise direction in FIG. 15. At this time, the fluid pressure cylinder 107 is lifted in the slanted upper direction with the horizontal support plate 25 and the molten metal is injected into the storing chamber 42.

After the injection of the molten metal, the tilt cylinder (not shown) is operated to return the horizontal support plate 25 into a state shown in FIG. 14 and the upper mold unit 22 is moved downwardly to the lower mold unit 21 for mold matching. In this state, after the pressure in the cavity 75 is decreased by the first and second pressure-decreasing mechanisms (not shown), the fluid pressure cylinder 107 is operated to inject the molten metal accommodated in the storing chamber 42 into the cavity 75

In this modification, the molding operation of products is carried out efficiently because only one mold matching operation is carried out.

Figure 16:
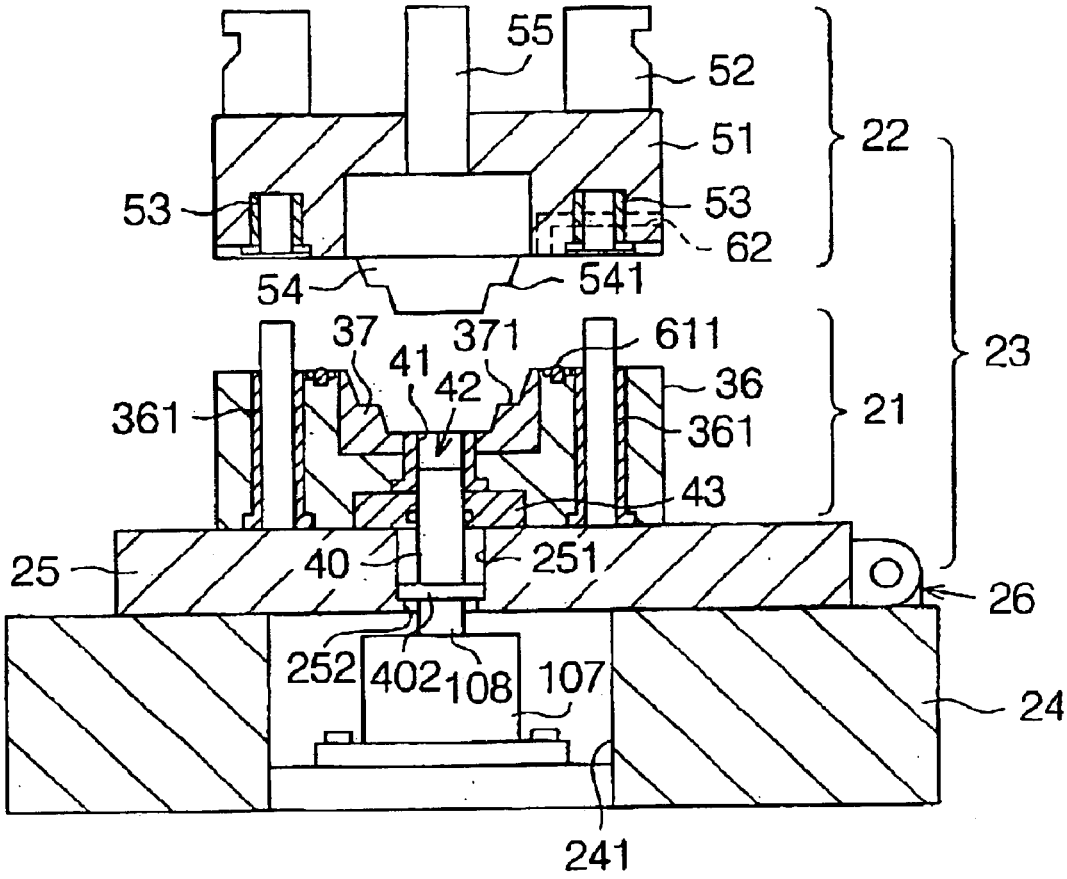
FIG. 16 is a cross sectional view of a molding device according to a modification of the embodiment of the present invention shown in FIG. 14.
Figure 17:
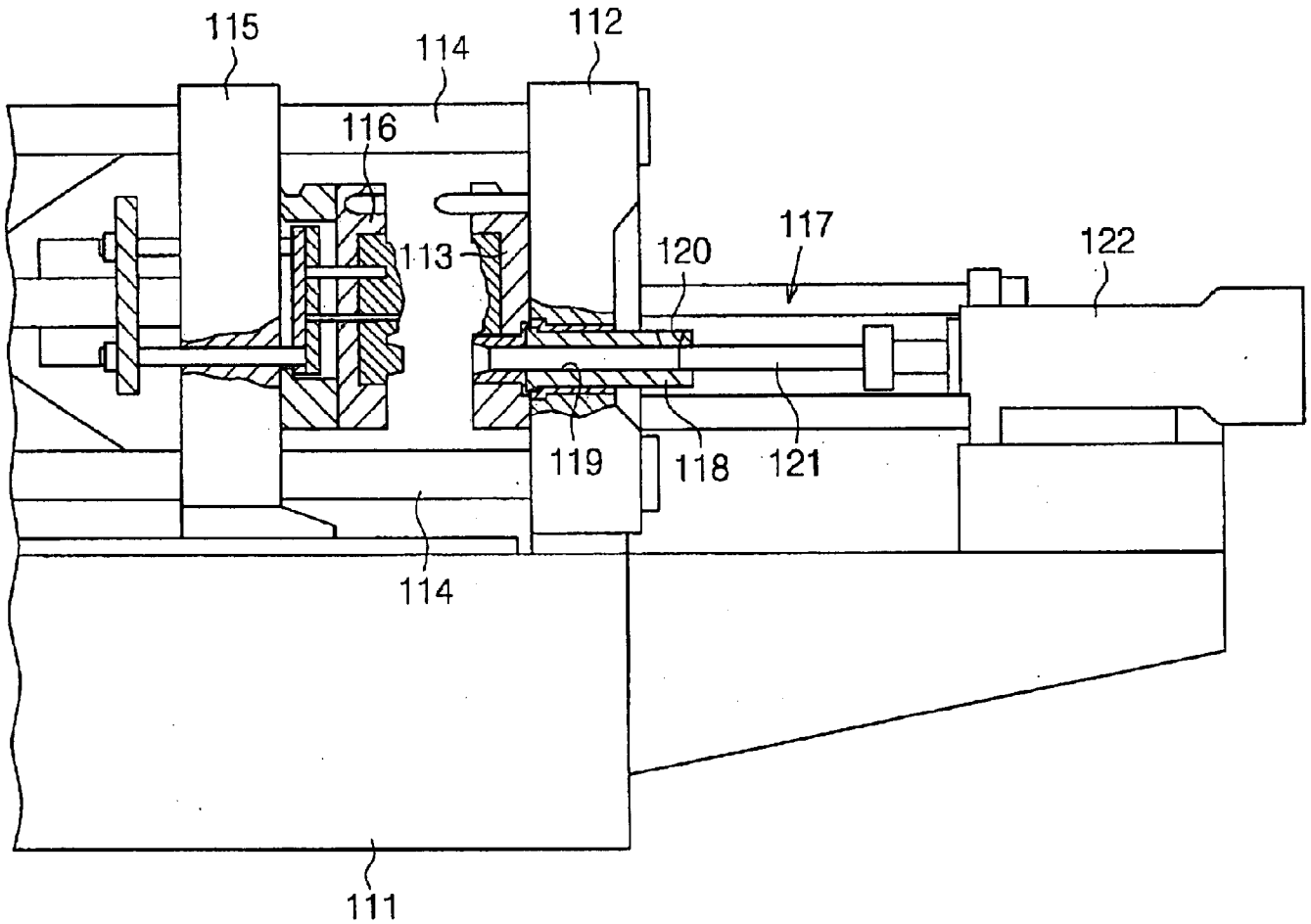
Fig.17 (Prior Art)
FIG. 17 is a cross sectional view of a prior art molding device.

The modification shown in FIG. 16 is a modified example of the modification shown in FIG. 14. The fluid pressure cylinder 107 is fixed to the bottom of the accommodation hole 241 of the base plate 24. A flange 402 is integrally formed with the lower end of the injection rod 40. The flange 402 is supported by a step 252 that is arranged at the bottom of the penetration aperture 251 of the horizontal support plate 25 so as not to be movable downwardly. Moreover, the lower end surface of the injection rod 40 is pressed upward by the upper end surface of the piston rod 108 of the fluid pressure cylinder 107.

In this modification, because the piston rod 108 of the fluid pressure cylinder 107 is separated from the injection rod 40, it is not necessary to lift the fluid pressure cylinder 107 when the horizontal support plate 25 is tilted. Other structure and operation are the same as that of the modification shown in FIG. 14.

Figure 8:
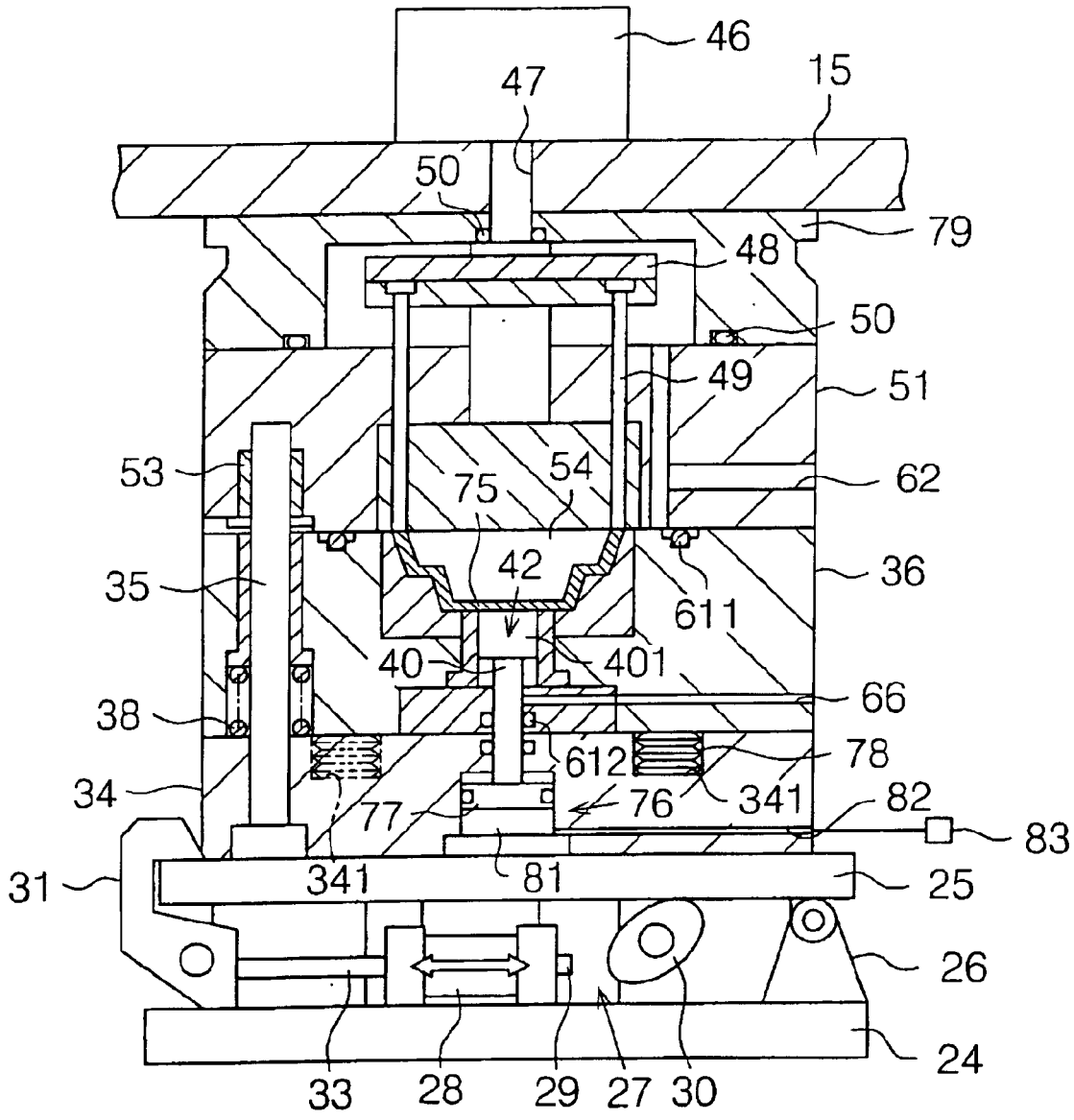
FIG. 8 is a cross sectional view of a molding device according to a second embodiment of the present invention.

In the embodiment shown in FIG. 8, the cylinder 76 may function as a pushing up cylinder.

In the above embodiment, the molten metal is used to manufacture a product, however, semi-coagulant may be used as a material to be molded to mold a product. For example, a material to be molded of a metal such as solid aluminum that is heated to 200–300° C. is stored in the storing chamber 42 so that hot molding may be carried out.

A hydraulic cylinder may be used as the lift maintaining mechanism of the lower mold-holding member 36 instead of the coil spring 38. In this case, the hydraulic cylinder lifts and maintains the lower mold-holding member 36 at a predetermined height position at the pressure decreased vacuum state against the high pressure power for compressing the solid during the hot molding of the solid.

As is not shown, the first seal ring 611 may be arranged in a circular groove that is formed on the lower surface of the upper mold-holding member 51. The second seal ring 612 may be arranged in a circular groove that is formed on the outer circumferential surface of the injection rod 40.

The hinge mechanism 26 and the tilt mechanism 27 may be omitted.

An actuator such as a cylinder for pushing out a product may be arranged below the base plate 24.

The first pressure-decreasing passage 62 may be formed on the lower mold-holding member 36 side.

In each embodiment, the lower mold unit 21 may be moved to the stand-by position that is frontward or rearward from the mold matching position.

In each embodiment shown in FIGS. 1–7, 8, 9, and 10, the horizontal support plate 25 may be arranged in a predetermined position so as not be movable.

In the modifications shown in FIG. 14 or 16, the fluid pressure cylinder 107 may function as a cylinder for pushing out a product.

In the embodiments shown in FIGS. 1–7, the lock lever 31 may be released automatically by the piston rod 33.

In the embodiment shown in FIG. 8, the lower surface of the piston 77 may be urged upwardly by a spring and the passage 82 and the relief valve 83 may be omitted.

Therefore, the present examples and embodiments are to be considered as illustrative and not restrictive and the invention is not to be limited to the details given herein, but may be modified within the scope and equivalence of the appended claims.

What is claimed is:

1. A molding device comprising:

a first mold unit;

a second mold unit arranged to face the first mold unit, wherein the first mold unit and the second mold unit relatively approach and are separated from each other, and wherein, when the first mold unit and the second mold unit approach each other to be closed, a molding cavity is defined between the first mold unit and the second mold unit;

a storing chamber arranged in at least one of the first mold unit and the second mold unit, wherein the storing chamber is communicated with the molding cavity and stores molten material;

a pushing mechanism, wherein the pushing mechanism pushes out the molten material in the storing chamber to the molding cavity when the molding cavity is defined between the first mold unit and the second mold unit, wherein the pushing mechanism includes a pushing rod that is inserted to the storing chamber, the pushing rod having an end surface that forms a bottom of the storing chamber, wherein one of the first and second mold units has an insertion hole that is communicated with the storing chamber and receives the pushing rod, wherein a predetermined second space is defined between an outer circumferential surface of the pushing rod and an inner circumferential surface of the insertion hole;

a first pressure-decreasing mechanism for decreasing pressure in the molding cavity prior to pushing out the molten material in the storing chamber to molding cavity; and a second pressure-decreasing mechanism for decreasing pressure on a side of the molten material that is opposite to the molding cavity substantially at the same time that the pressure in the molding cavity is decreased, wherein the second pressure-decreasing mechanism includes a second seal member and a second pressure-decreasing passage, wherein the second seal member seals a space between the outer circumferential surface of the rushing rod and the inner circumferential surface of the insertion hole, and wherein the second pressure-decreasing passage is communicated with a part of the second space between the second seal member and the storing chamber.

2. The molding device according to claim 1, wherein each of the first mold unit and the second mold unit has a facing surface, the facing surfaces facing each other, and the pressure-decreasing mechanism includes a first seal member arranged between the facing surfaces and a first pressure-decreasing passage that is open in at lease one of the facing surfaces, and when the facing surfaces approach each other such that a predetermined first space is defined between the facing surfaces, the first seal member seals a space between the facing surfaces to surround the molding cavity and a part of the first space, and the first pressure-decreasing passage is communicated with the molding cavity via the part of the first space that is surrounded by the first seal member.

3. The molding device according to claim 1 further comprising a cooling mechanism that cools down the second seal member.

4. The molding device according to claim 1, wherein the first mold unit is a lower mold unit and the second mold unit is an upper mold unit that is arranged above the lower mold unit, and wherein the storing chamber and the pushing mechanism are arranged in the lower mold unit.

5. The molding device according to claim 4, wherein the lower mold unit includes a movable member that defines a part of the molding cavity and has the storing chamber, and wherein the pushing rod pushes out the molten material in the storing chamber to the molding cavity as the movable member moves together with the upper mold unit with respect to the pushing rod.

6. The molding device according to claim 4, wherein the lower mold unit includes a horizontal support plate, a lower mold-holding member that is supported on the horizontal support plate to reciprocate in a vertical direction, a lower mold that is held by the lower mold-holding member, and a lift-maintaining mechanism that lifts the lower mold-holding member and maintains the lower mold-holding member at a predetermined height position from the horizontal support plate, wherein the pushing rod that is arranged upward from the horizontal support plate, and wherein the pushing rod pushes out the molten material in the storing chamber to the molding cavity as the lower mold-holding member is pushed down toward the horizontal support plate by the upper mold unit.

7. The molding device according to claim 4, wherein the lower mold unit includes a position adjustment mechanism that adjusts an axial position of the pushing rod according to the amount of the molten material in the storing chamber.

8. The molding device according to claim 4, wherein the first and second mold units relatively move in a vertical direction and a horizontal direction.

9. The molding device according to claim 4, wherein the lower mold unit has a tilt mechanism that tilts the storing chamber.

10. A molding device comprising:

a lower mold unit;

an upper mold unit arranged above the lower mold unit to be capable of approaching and separating from the lower mold unit, wherein a molding cavity is defined between the lower mold unit and the upper mold unit when the upper mold unit approaches the lower mold unit to be closed;

a storing chamber arranged in the lower mold unit, wherein the storing chamber is communicated with the molding cavity and stores molten material;

a first pressure-decreasing mechanism for decreasing pressure in the molding cavity when the molding cavity is defined between the lower mold unit and the upper mold unit;

a second pressure-decreasing mechanism for decreasing pressure on a side of the molten material that is opposite to the molding cavity substantially at the same time that the pressure in the molding cavity is decreased; and a pushing mechanism arranged in the lower mold unit for pushing out the molten material in the storing chamber to the molding cavity when the pressure in the molding cavity is decreased, wherein the pushing mechanism includes a pushing rod that is inserted to the storing chamber, the pushing rod having an end surface that forms a bottom of the storing chamber, wherein the lower mold unit has an insertion hole that is communicated with the storing chamber and receives the pushing rod, wherein a predetermined second space is defined between an outer circumferential surface of the pushing rod and an inner circumferential surface of the insertion hole, wherein the second pressure-decreasing mechanism includes a second seal member and a second pressure-decreasing passage, wherein the second seal member seals a space between the outer circumferential surface of the pushing rod and the inner circumferential surface of the insertion hole, and wherein the second pressure-decreasing passage is communicated with a part of the second space between the second seal member and the storing chamber.

11. The molding device according to claim 10, wherein each of the lower mold unit and the upper mold unit has a facing surface, the facing surface facing each other, and the first pressure-decreasing mechanism includes a first seal member arranged between the facing surfaces and a first pressure-decreasing passage that is open in one of the facing surfaces, and when the facing surfaces approach each other such that a predetermined first space is defined between the facing surfaces, the first seal member seals a space between the facing surfaces to surround the molding cavity and a part of the first space, and the fist pressure-decreasing passage is communicated with the molding cavity via the part of the first space that is surrounded by the first seal member.

12. The molding device according to claim 10 further comprising a cooling mechanism that cools down the second seal member.

13. A molding device comprising:

a lower mold unit, wherein the lower mold unit includes a horizontal support plate, a lower mold-holding member that is supported on the horizontal support plate to reciprocate in a vertical direction, a lower mold that is held by the lower mold-holding member, and a lift-maintaining mechanism that lifts the lower mold-holding member and maintains the lower mold-holding member at a predetermined height position from the horizontal support plate;

an upper mold unit arranged above the lower mold unit, wherein the lower mold unit and the upper mold unit relatively approach and are separated from each other, and wherein, when the lower mold unit and the upper mold unit approach each other to be closed, a molding cavity is defined between the lower mold unit and the upper mold unit;

a storing chamber arranged in the lower mold unit, wherein the storing chamber is communicated with the molding cavity and stores molten material; and a pushing mechanism arranged in the lower mold unit for pushing out the molten material in the storing chamber to the molding cavity when the molding cavity is defined between the lower mold unit and the upper mold unit, wherein the pushing mechanism includes a pushing rod that is arranged upward from the horizontal support plate, the pushing rod having an end surface that forms a bottom of the storing chamber, and wherein the pushing rod pushes out the molten material in the storing chamber to the molding cavity as the lower mold-holding member is pushed down toward the horizontal support plate by the upper mold unit.

14. A molding device comprising:

a lower mold unit;

an upper mold unit arranged above the lower mold unit, wherein the lower mold unit and the upper mold unit relatively approach and are separated from each other, and wherein, when the lower mold unit and the upper mold unit approach each other to be closed, a molding cavity is defined between the lower mold unit and the upper mold unit;

a storing chamber arranged in the lower mold unit, wherein the storing chamber is communicated with the molding cavity and stores molten material;

a pushing mechanism arranged in the lower mold unit for pushing out the molten material in the storing chamber to the molding cavity when the molding cavity is defined between the lower mold unit and the upper mold unit; and a position adjustment mechanism arranged in the lower mold unit for adjusting an axial position of the pushing mechanism according to the amount of the molten material in the storing chamber.

* * * * *